US008341991B2

(12) United States Patent
Goto

(10) Patent No.: US 8,341,991 B2
(45) Date of Patent: Jan. 1, 2013

(54) MANUFACTURING METHOD AND MANUFACTURING APPARATUS FOR TWISTED FLAT BAR

(76) Inventor: Tsuneo Goto, Koshi (JP)

( * ) Notice: Subject to any disclaimer, the term of this patent is extended or adjusted under 35 U.S.C. 154(b) by 186 days.

(21) Appl. No.: 12/734,047

(22) PCT Filed: Oct. 8, 2008

(86) PCT No.: PCT/JP2008/068302

§ 371 (c)(1),
(2), (4) Date: May 25, 2010

(87) PCT Pub. No.: WO2009/048079

PCT Pub. Date: Apr. 16, 2009

(65) Prior Publication Data

US 2010/0294011 A1 Nov. 25, 2010

(30) Foreign Application Priority Data

Oct. 9, 2007 (JP) ..... 2007-263272

(51) Int. Cl.
*B21D 11/14* (2006.01)

(52) U.S. Cl. ..... 72/64; 72/371

(58) Field of Classification Search ..... 72/64, 371
See application file for complete search history.

(56) References Cited

U.S. PATENT DOCUMENTS 3,421,351 A * 1/1969 Doran et al. ..... 72/64

FOREIGN PATENT DOCUMENTS

| | | | |
|---|---|---|---|
| JP | 48-008711 | B | 3/1973 |
| JP | 55-068130 | A | 5/1980 |
| JP | 63-192520 | A | 8/1988 |
| JP | 64-015229 | A | 1/1989 |
| JP | 10-061742 | A | 3/1998 |
| JP | 10-296342 | A | 11/1998 |
| JP | 2001-136844 | A | 5/2001 |

* cited by examiner

*Primary Examiner* — Faye Francis
(74) *Attorney, Agent, or Firm* — Chapman and Cutler LLP

(57) ABSTRACT

An object of the invention is to provide a manufacturing method and an apparatus for a twisted flat bar which can prevent the pitch from becoming inconsistent and makes it possible to process a long flat bar into a twisted flat bar. A flat bar (5) is sandwiched between two round bars (7), which are positioned so as to be inclined at the same angle in different directions relative to the longitudinal direction of the flat bar from the two sides, and the above described two round bars are rotated relative to the flat bar around the rotational axis in the longitudinal direction of the flat bar, and at the same time, the flat bar is moved in the longitudinal direction of the flat bar relative to the round bars.

16 Claims, 20 Drawing Sheets

MANUFACTURING METHOD AND MANUFACTURING APPARATUS FOR TWISTED FLAT BAR

TECHNICAL FIELD

The present invention relates to a method and apparatus for twisting a flat bar and manufacturing a twisted flat bar.

BACKGROUND ART

Twisted flat bars gained by twisting a flat bar have such a form as shown by the symbol 6 in FIG. 17, for example, and iron, aluminum, stainless steel and the like are used as the material for the bar.

These twisted flat bars are buried in the ground and used as an anchor in order to secure a structure, such as a bench and a sign, to the ground, and in recent years, have been used as a foundation pile for forming a support or the like of a large building, as a part that forms a conveyance mechanism of a conveying apparatus, as shown in Patent Documents 1 and 2, and furthermore, as an ornament inside and outside a building.

Patent Document 1: Japanese Unexamined Patent Publication H10 (1998)-61742

Patent Document 2: Japanese Unexamined Patent Publication 2001-136844

A manufacturing method for such a twisted flat bar is disclosed in Patent Document 3, where a flat bar (5) is first attached to a fixture (2) attached to the output axis of a motor A (1) and a fixed dolly attached to the rod of a hydraulic cylinder (3), as shown in FIG. 17. Then, the motor is driven in such a state that a tensile force is applied to the hydraulic cylinder. Thus, the flat bar is twisted in such a state that a constant tensile force is applied so that a twisted flat bar can be manufactured. Here, the entire length of the completed twisted flat bar is slightly shorter than the entire length of the original flat bar. It is possible to manufacture a twisted flat bar up to a length of 6 m according to this method used for manufacturing by the present applicant.

Patent Document 3: Japanese Unexamined Patent Publication H10 (1998)-296342

However, the pitches of conventional twisted flat bars have different dimensions when measured precisely though the pitches look uniform when viewed visually, and when such a twisted flat bar is used as a feeding screw in a conveying apparatus, as shown in Patent Documents 1 and 2, the nut is caught by the twisted flat bar due to the inconsistency in the pitch, and thus, a problem arises such that it is difficult to move the nut relative to the twisted flat bar.

In addition, in the case where a number of twisted flat bars are aligned in parallel and used as a wall ornament or the like, a subtle inconsistency in the pitches can be clearly seen, which causes great damage aesthetically.

The reasons why these pitches are not uniform are (1) the material of the flat bar is inconsistent, and (2) it is difficult to apply a uniform twisting force throughout the entirety of the flat bar when the twisted flat bar is long in accordance with the method in which the two ends of the flat bar are held and twisted, as in Patent Document 3. In particular, when the twisted flat bar is long, sometimes the above described two reasons both contribute, which makes it extremely difficult to manufacture a long, twisted flat bar with uniform pitches.

DISCLOSURE OF THE INVENTION

Problem to be Solved by the Invention

The present invention is provided in order to solve the above described problems, and an object of the invention is to provide a manufacturing method and a manufacturing apparatus for a flat bar which can prevent inconsistency of the pitches and allows even a long flat bar to be processed into a twisted flat bar.

Means for Solving Problem

In order to achieve the above described object, the invention according to Claim 1 provides a manufacturing method for a twisted flat bar, characterized in that a flat bar is sandwiched between two round bars, which are positioned so as to be inclined at the same angle in different directions relative to the longitudinal direction of the flat bar from the two sides, and the above described two round bars are rotated relative to the flat bar around the rotational axis in the longitudinal direction of the flat bar, and at the same time, the flat bar is moved in the longitudinal direction of the flat bar relative to the round bars.

The invention according to Claim 2 provides a manufacturing method for a twisted flat bar, characterized in that a flat bar is sandwiched between two round bars, which are positioned so as to be inclined at the same angle in different directions relative to the longitudinal direction of the flat bar from the two sides, the flat bar is held by a first holding means and a second holding means positioned on either side of the round bars in the longitudinal direction of the flat bar, and the round bars and the first holding means are rotated around a rotational axis in the longitudinal direction of the flat bar relative to the second holding means, and at the same time moved relative to the second holding means in the longitudinal direction of the flat bar so as to move away from the second holding means.

The invention according to Claim 3 provides the manufacturing method for a twisted flat bar according to Claim 2, characterized in that the first holding means holds the flat bar so that it is possible for the flat bar to move relative to the first holding means in the longitudinal direction of the flat bar while the second holding means holds the flat bar in such a manner that the flat bar is prevented from moving relative to the second holding means in the longitudinal direction of the flat bar.

The invention according to Claim 4 provides the manufacturing method for a twisted flat bar according to Claim 2 or 3, characterized in that the round bars and the first holding means move in the longitudinal direction of the flat bar while maintaining a predetermined distance from each other, and at the same time rotate around the rotational axis while maintaining a predetermined rotational angle.

The invention according to Claim 5 provides a manufacturing apparatus for a twisted flat bar, characterized by having: two round bars, which are positioned so as to be inclined at the same angle in different directions relative to the longitudinal direction of the flat bar, for sandwiching a flat bar from the two sides; a first holding means and a second holding means for holding the flat bar, which are positioned on either side of the round bars at a distance from each other in the longitudinal direction; a rotational means for rotating the round bars and the first holding means around the rotational axis in the longitudinal direction of the flat bar relative to the second holding means; and a moving means for moving the round bars and the first holding means in the longitudinal direction of the flat bar relative to the flat bar.

The invention according to Claim 6 provides the manufacturing apparatus for a twisted flat bar according to Claim 5, characterized in that the first holding means is formed so as to hold the flat bar in such a manner that it is possible for the flat bar to move relative to the first holding means in the longitudinal direction of the flat bar while the second holding means is formed so as to hold the flat bar in such a manner that the flat bar is prevented from moving relative to the second holding means in the longitudinal direction of the flat bar.

The invention according to Claim 7 provides the manufacturing apparatus for a twisted flat bar according to Claim 5 or 6, characterized in that at least the round bars and the first holding means are integrally incorporated in a movable dolly.

The invention according to Claim 8 provides the manufacturing apparatus for a twisted flat bar according to any of Claims 5 to 7, characterized in that the rotational means is formed of a rotational body which incorporates the round bars, and a rotational drive means for rotating the rotational body.

The invention according to Claim 9 provides the manufacturing apparatus for a twisted flat bar according to any of Claims 5 to 8, characterized in that the first holding means is formed of two rollers for sandwiching the flat bar from the two sides.

The invention according to Claim 10 provides a manufacturing apparatus for a twisted flat bar, characterized by having: two round bars, which are positioned so as to be inclined at the same angle in different directions relative to the longitudinal direction of the flat bar, for sandwiching a flat bar from the two sides; a rotational means for rotating the round bars relative to the flat bar around the rotational axis in the longitudinal direction of the flat bar; and a conveyance means for moving the flat bar relative to the round bars in the longitudinal direction of the flat bar.

The invention according to Claim 11 provides the manufacturing apparatus for a twisted flat bar according to Claim 10, characterized in that holding rollers for sandwiching the flat bar are provided between the rotational means and the conveyance means, and formed so that the flat bar is twisted between the holding rollers and the round bars.

EFFECTS OF THE INVENTION

The invention according to Claim 1 provides a manufacturing method for a twisted flat bar, characterized in that a flat bar is sandwiched between two round bars, which are positioned so as to be inclined at the same angle in different directions relative to the longitudinal direction of the flat bar from the two sides, and the above described two round bars are rotated relative to the flat bar around the rotational axis in the longitudinal direction of the flat bar, and at the same time, the flat bar is moved in the longitudinal direction of the flat bar relative to the round bars, and therefore, when a flat bar is twisted, the round bars act as a guide for the twisted flat bar, so that a twisted flat bar with a uniform pitch and pitch angle can be gained. That is to say, the pitch angle of the twisted flat bar is set in the direction of the center axis of the round bars, and the pitch is set in accordance with the radius of curvature of the round bars, and therefore, it becomes possible for the pitch to be uniform along the entire length of the twisted flat bar. In addition, it is also easy to adjust the pitch and pitch angle by changing the angle and diameter of the round bars. Furthermore, it is also possible to set various pitches and pitch angles by adjusting the speed of rotational movement between the flat bar and the round bars around the rotational axis in the longitudinal direction of the flat bar, and the speed of translation of the flat bar through the round bars in the longitudinal direction of the flat bar.

The invention according to Claim 2 provides a manufacturing method for a twisted flat bar, characterized in that a flat bar is sandwiched between two round bars, which are positioned so as to be inclined at the same angle in different directions relative to the longitudinal direction of the flat bar from the two sides, the flat bar is held by a first holding means and a second holding means positioned on either side of the round bars in the longitudinal direction of the flat bar, and the round bars and the first holding means are rotated around a rotational axis in the longitudinal direction of the flat bar relative to the second holding means, and at the same time moved relative to the second holding means in the longitudinal direction of the flat bar so as to move away from the second holding means, and therefore, when a flat bar is twisted between the first holding means and the second holding means, the round bars act as a guide for the twisted flat bar, so that a twisted flat bar having a uniform pitch and pitch angle can be gained. That is to say, the pitch angle of the twisted flat bar is set in the direction of the center axis of the round bars, and the pitch is set in accordance with the radius of curvature of the round bars, and therefore, it becomes possible for the pitch to be uniform along the entire length of the twisted flat bar. In addition, it is also easy to adjust the pitch and pitch angle by changing the angle and diameter of the round bars.

In addition, the round bars and the first holding means move in the longitudinal direction of the flat bar so as to move away from the second holding means, and therefore, it becomes possible to process even long flat bars into a twisted flat bar with a uniform pitch.

According to the invention according to Claim 3, the first holding means holds the flat bar so that it is possible for the flat bar to move relative to the first holding means in the longitudinal direction of the flat bar while the second holding means holds the flat bar in such a manner that the flat bar is prevented from moving relative to the second holding means in the longitudinal direction of the flat bar, and therefore, it is possible for the first holding means and the second holding means to move away from each other while twisting a flat bar between the first holding means and the second holding means, and even long flat bars can be twisted.

In addition, even when the flat bar is twisted and a force is applied in such a direction that the flat bar becomes shorter, the second holding means is formed so as to prevent the flat bar from moving relative to the second holding means in the longitudinal direction of the flat bar, and thus, the flat bar can be maintained in such a state that a predetermined tensile force is applied, thus making it possible to prevent inconsistency in the pitch.

According to the invention according to Claim 4, the round bars and the first holding means move in the longitudinal direction of the flat bar while maintaining a predetermined distance from each other, and at the same time rotate around the rotational axis while maintaining a predetermined rotational angle, and therefore, it is possible to twist a flat bar continuously with a predetermined pitch.

The invention according to Claim 5 provides a manufacturing apparatus for a twisted flat bar, characterized by having: two round bars, which are positioned so as to be inclined at the same angle in different directions relative to the longitudinal direction of the flat bar, for sandwiching a flat bar from the two sides; a first holding means and a second holding means for holding the flat bar, which are positioned on either side of the round bars at a distance from each other in the longitudinal direction; a rotational means for rotating the round bars and the first holding means around the rotational axis in the longitudinal direction of the flat bar relative to the second holding means; and a moving means for moving the round bars and the first holding means in the longitudinal direction of the flat bar relative to the flat bar, and therefore, as in Claim 2, the round bars act as a guide for the twisted flat bar, and it is possible to prevent inconsistency in the pitch of the twisted flat bar.

In addition, the round bars and the first holding means can be moved in the longitudinal direction of the flat bar, and therefore, the pitch becomes uniform along the entire length of the twisted flat bar, and it is possible to process even long flat bars into a twisted flat bar with a uniform pitch.

According to the invention according to Claim 6, the first holding means is formed so as to hold the flat bar in such a manner that it is possible for the flat bar to move relative to the first holding means in the longitudinal direction of the flat bar while the second holding means is formed so as to hold the flat bar in such a manner that the flat bar is prevented from moving relative to the second holding means in the longitudinal direction of the flat bar, and therefore, it is possible for the first holding means and the second holding means to move away from each other while twisting a flat bar between the first holding means and the second holding means, and even long flat bars can be twisted.

In addition, even when the flat bar is twisted and a force is applied in such a direction that the flat bar becomes shorter, the second holding means is formed so as to prevent the flat bar from moving relative to the second holding means in the longitudinal direction of the flat bar, and thus, the flat bar can be maintained in such a state that a predetermined tensile force is applied, thus making it possible to prevent inconsistency in the pitch.

According to the invention according to Claim 7, at least the round bars and the first holding means are integrally incorporated in a movable dolly, and therefore, it is possible to move the round bars and the first holding means stably along the entire length of the flat bar while holding the round bars and the first holding means for carrying out a twisting process on a flat bar with a predetermined positional relationship.

According to the invention according to Claim 8, the rotational means is formed of a rotational body, which incorporates the round bars, and a rotational drive means for rotating the rotational body, and therefore, the round bars can be rotated around the first holding means.

Here, in the case where the rotational drive means installed in the same dolly as the rotational body incorporating the round bars, it becomes possible to simplify the mechanism for conveying the drive force from the rotational drive means to the rotational body.

According to the invention according to Claim 9, the first holding means is formed of two rollers for sandwiching the flat bar from the two sides, and therefore, the flat bar is prevented from rotating when the flat bar is twisted, smooth movement is possible when the round bars and the first holding means are moved in the longitudinal direction of the flat bar, and it is also possible to prevent the flat bar from becoming damaged when the first holding means moves.

The invention according to Claim 10 provides a manufacturing apparatus for a twisted flat bar, characterized by having: two round bars, which are positioned so as to be inclined at the same angle in different directions relative to the longitudinal direction of the flat bar, for sandwiching a flat bar from the two sides; a rotational means for rotating the round bars relative to the flat bar around the rotational axis in the longitudinal direction of the flat bar; and a conveyance means for moving the flat bar relative to the round bars in the longitudinal direction of the flat bar, and therefore, as in Claim 1, the round bars act as a guide for the twisted flat bar, and it becomes possible to prevent the pitch of the twisted flat bar from becoming inconsistent.

In addition, the flat bar is movable relative to the round bars in the longitudinal direction of the flat bar, and therefore, the pitch becomes uniform along the entire length of the twisted flat bar, and at the same time, it is possible to process even long flat bars to a twisted flat bar with a uniform pitch.

In addition, it is possible to feed a flat bar continuously through the round bars using the conveyance means, and it is also possible to twist a flat bar that is continuously fed from a blast furnace or a rolling mill, for example. Naturally the twisting process can be carried out regardless of whether the flat bar is hot rolled or cold rolled.

According to the invention according to Claim 11, holding rollers for sandwiching the flat bar are provided between the rotational means and the conveyance means, and formed so that the flat bar is twisted between the holding rollers and the round bars, and therefore, the conveyance means may simply function to convey a flat bar, and the mechanical structure of the conveyance means is simple, and at the same time, it is not necessary for the mechanical strength to be set high (particularly the mechanical strength for bearing the rotation of the round bars).

BRIEF DESCRIPTION OF THE DRAWINGS

FIG. 2B is a front diagram and FIG. 1C is a side diagram showing a round bar and its bearings;

EXPLANATION OF SYMBOLS

Figure 1A:
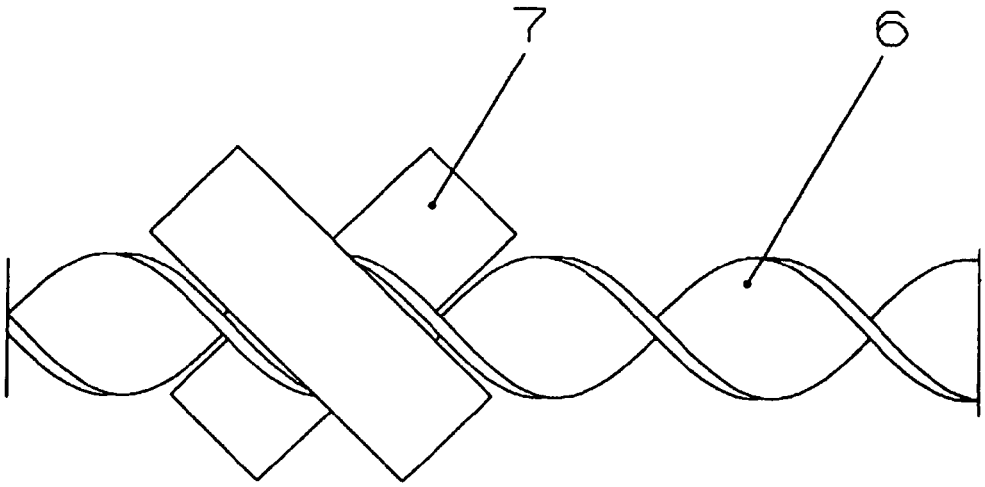
FIG. 1A is a plan diagram and FIG. 1B is a front diagram showing a twisted flat bar and round bars.

1 motor A
2 fixture

3 hydraulic cylinder
4 fixed dolly
5 flat bar
6 twisted flat bar
7 round bar
8 rotational body
9 movable dolly
10 fixed portion
11 roller
12 bearing A
13 table
14 disc
15 gear A
16 pipe
17 bearing B
18 frame
19 motor B
20 gear B
21 wheel
22 C-shaped bar
23 fixed axis
24 ball bearing
25 thrust bearing
26 support plate
27 main body
28 sprocket
29 chain
30 motor C
31 conveyance means (conveyance roller)
32 holding roller
33 base

BEST MODE FOR CARRYING OUT THE INVENTION

The manufacturing method for a twisted flat bar according to the present invention is a manufacturing method for a twisted flat bar, characterized in that a flat bar is sandwiched between two round bars, which are positioned so as to be inclined at the same angle in different directions relative to the longitudinal direction of the flat bar from the two sides, and the above described two round bars are rotated relative to the flat bar around the rotational axis in the longitudinal direction of the flat bar, and at the same time, the flat bar is moved in the longitudinal direction of the flat bar relative to the round bars.

The manufacturing method and manufacturing apparatus for a twisted flat bar according to the present invention are described in detail below.

Figure 1B:
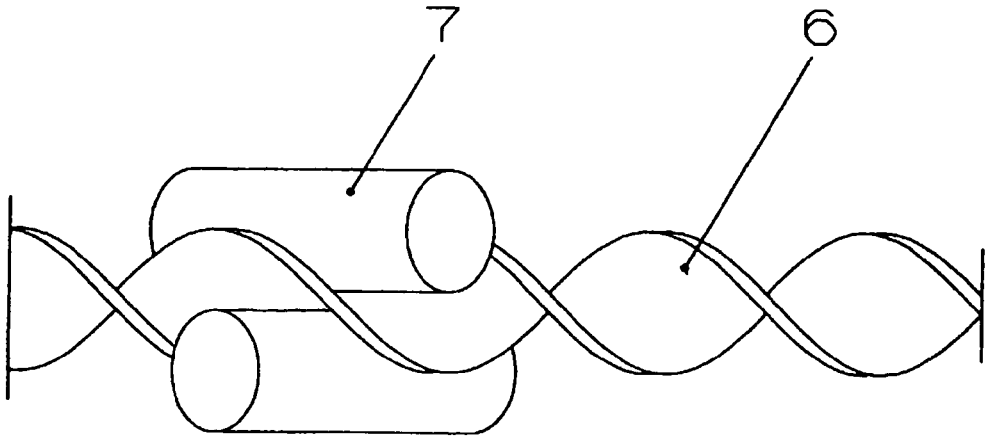

FIG. 1 is a diagram showing the positional relationship between the twisted flat bar and the round bars; FIG. 1A is a plan diagram, and FIG. 1B is a front diagram.

The present invention is characterized in that a flat bar is twisted using two round bars positioned so as to be inclined in different directions at the same angle relative to the longitudinal direction of the flat bar. As a result, the round bars act as a guide for the flat bar being twisted. The pitch angle of the twisted flat bar matches the direction of the center axis of the round bars, and the pitch is set in accordance with the radius of curvature of the round bars, and therefore, it is possible to twist the flat bar with a stable pitch. FIG. 1 shows the positional relationship between the twisted flat bar and the round bars, and the twisted portion of the twisted flat bar (6) can be sandwiched between two round bars (7) which cross at 90 degrees, for example. Here, it is also easy to adjust the pitch and the pitch angle by changing the angle and the diameter of the round bars.

Figure 15A:
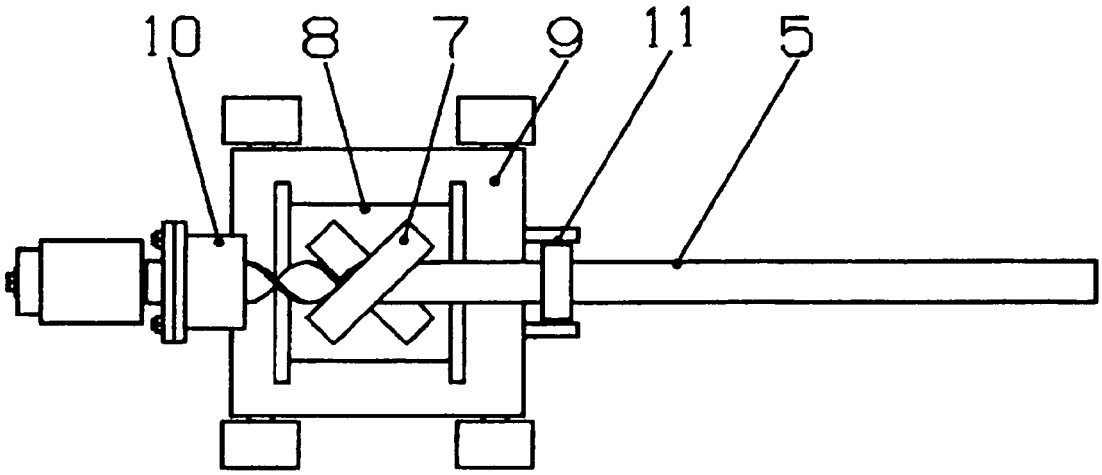
FIGS. 15A, 15B and 15C are diagrams showing the working steps of inserting a flat bar, starting twisting, and moving a movable dolly.
Figure 15B:
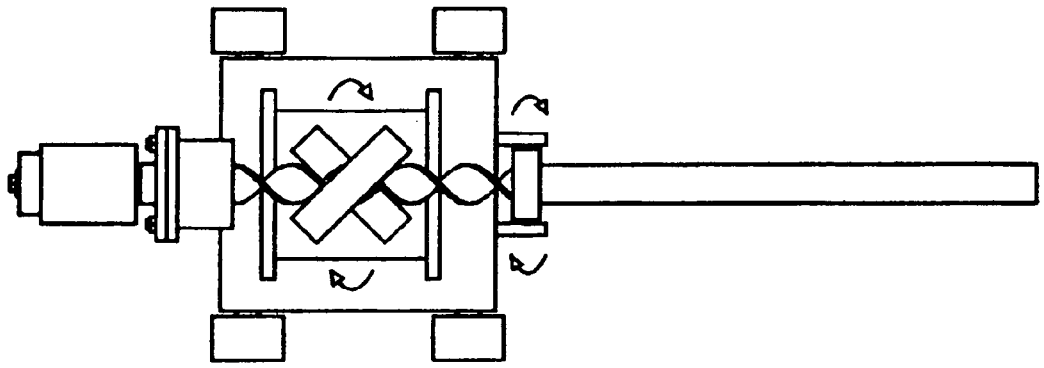
Figure 15C:
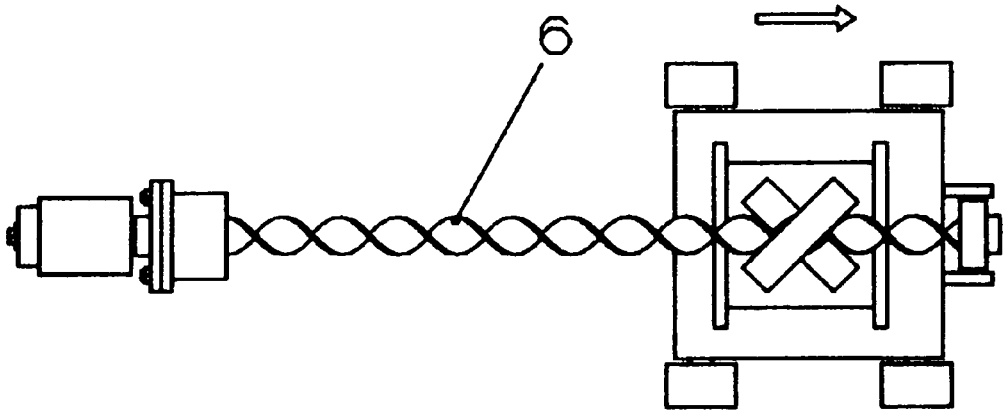

FIG. 15 is a diagram showing the work steps in the present invention; FIG. 15A shows how a flat bar (5) is inserted, FIG. 15B shows how the flat bar starts being twisted, and FIG. 15C shows how the movable dolly including the round bars (8) moves.

Concretely, as shown in FIG. 15, two round bars (7) crossing at an angle of 90 degrees are incorporated in a rotational body (8) that forms part of a rotational means, and installed in a movable dolly (9) which moves when the rotational body is rotated using electric power.

In addition, the two rollers (11), which are a first holding means, are formed so as to sandwich a flat bar (5) and attached to the rear of the movable dolly (9) so as to rotate in sync with the rotational body having the round bars, in the same direction. In addition, the flat bar (5) to the right of the first holding means (11) rotates in the same direction as the first holding means.

Here, though in the below embodiment, the round bars (7) and the rollers, which are the first holding means, rotate, the present invention is not limited to this, and it is possible to rotate the fixed portion (10), which is the second holding means, without rotating the round bars and the first holding means.

Next, the fixed portion (10), which is the second holding means, is installed in front of the movable dolly (left in the figure), and the fixed portion fixes the end of the flat bar (5), and at the same time, the fixed portion is fixed so as to not to rotate when the flat bar is twisted in the embodiment in FIG. 15. In addition, a thrust bearing is incorporated in the fixed portion (10), which can therefore withstand tensile force. The details of the fixed portion are described in detail below.

Though in the below described embodiment, a flat bar is fixed to the fixed portion (10) and the fixed portion (10) is fixed so as not to be movable in the longitudinal direction of the flat bar, the invention is not limited to this, and it is possible to form the fixed portion (10) so that the twisted flat bar can penetrate through the fixed portion (10), as well as for the fixed portion (10) to be incorporated in the movable dolly (9) if necessary. This configuration makes it possible to carry out a twisting process on a flat bar that is longer than the manufacturing apparatus.

In addition, in the case where the second holding means is rotated without rotating the round bars and the first holding means, a separate rotation drive means for rotating the fixed portion is provided.

This manufacturing method is described below. First, as shown in FIG. 15A, a flat bar (5) on which a twisting process is carried out over a certain length in advance is fixed to the fixed portion (10), and is positioned so as to pass between the round bars (7) and the rollers (11).

The minimum length of the portion of the flat bar (5) that is twisted in advance is the same as the initial distance between the fixed portion (10) and the round bars (7), as shown in FIG. 15A, and the length is preferably the same as the initial distance between the fixed portion (10) and the rollers (11), which are the first holding means, as shown in FIG. 15B.

Next, as shown in FIG. 15B, the rotational body (8) for holding the round bars (7) and the rollers (11), which are the first holding means, are rotated, and at the same time, the fixed portion (10), which is the second holding means, remains fixed, and thus, the flat bar is twisted.

As shown in FIG. 15A, in the case where the flat bar is not twisted between the round bars and the first holding means, the first holding means is rotated before the round bars, so that the state becomes as in FIG. 15B, and then the round bars and the first holding means are rotated in the same direction, at the same rotational speed.

In addition, as shown in FIG. 15C, the round bars and the first holding means are moved in the direction of the arrow (to the right in the figure) while rotating, so that a twisting process is carried out on the flat bar continuously.

Thus, when a flat bar is twisted between the rollers (11), which are the first holding means, and the fixed portion (10), which is the second holding means, the round bars (7) act as a guide for the flat bar being twisted, so that a twisted flat bar having a uniform pitch and pitch angle can be gained.

In addition, when the round bars (7) and the rollers (11) are moved in the longitudinal direction of the flat bar relative to the flat bar while twisting the flat bar continuously with a precise pitch, a twisted flat bar having the same pitch along the entire length can be gained.

That is to say, the manufacturing method for a twisted flat bar according to the present invention is characterized in that a flat bar (5) is sandwiched between two round bars (7), which are positioned so as to be inclined at the same angle in different directions relative to the longitudinal direction of the flat bar (5) from the two sides, and in addition, the flat bar is held by the first holding means (11) and the second holding means (10), which are positioned in the longitudinal direction of the flat bar on either side of the round bars, the above described two round bars and the first holding means are rotated relative to the second holding means around the rotational axis in the longitudinal direction of the flat bar, and at the same time, the flat bar is moved in the longitudinal direction of the flat bar so as to move away from the second holding means in the twisting step of twisting a flat bar.

In addition, the first holding means (11) holds the flat bar so that it is movable in the longitudinal direction of the flat bar relative to the flat bar, while the second holding means (10) holds the flat bar so that it is not movable in the longitudinal direction of the flat bar relative to the flat bar, and therefore, the distance between the first holding means and the second holding means can be widened while twisting the flat bar between the first holding means and the second holding means, thus making it possible to twist long flat bars.

In addition, the second holding means is formed so as not to be movable in the longitudinal direction of the flat bar relative to the flat bar, even when the flat bar is twisted and a force for shortening the flat bar is applied, and therefore, the flat bar can be kept in such a state that a predetermined tensile force is applied to the flat bar, thus making it possible to prevent the pitch from becoming inconsistent.

Furthermore, the round bars (7) and the first holding means (11) move in the longitudinal direction while keeping a predetermined distance, and at the same time rotate around the rotational axis in the longitudinal direction of the flat bar while maintaining a predetermined rotational angle, and therefore, it is possible to continuously twist the flat bar with a predetermined pitch.

The twisting process and movement in the present invention are possible through relative displacement, as described above, and concretely, whether the round bars and the first holding means are rotated, the second holding means is rotated, or the round bars and the first holding means are rotated in one direction while the second holding means is rotated in the direction can be determined on the basis with the form and material of the twisted flat bar to be manufactured through the twisting process. In addition, whether the round bars and the first holding means are moved, the flat bar is moved, or all three are moved together can be determined in the moving process.

In addition, the second holding means is not limited to being provided separately from the movable dolly, which moves the round bars and the first holding means, so as to be fixed to the main body of the apparatus, and various modifications are, of course, possible; for example the second holding means may be movable within the main body of the apparatus, or movable relative to the flat bar together with the round bars and the first holding means, as shown in FIG. 15.

Next, a manufacturing apparatus for a twisted flat bar using this manufacturing method is described in detail.

Figure 2A:
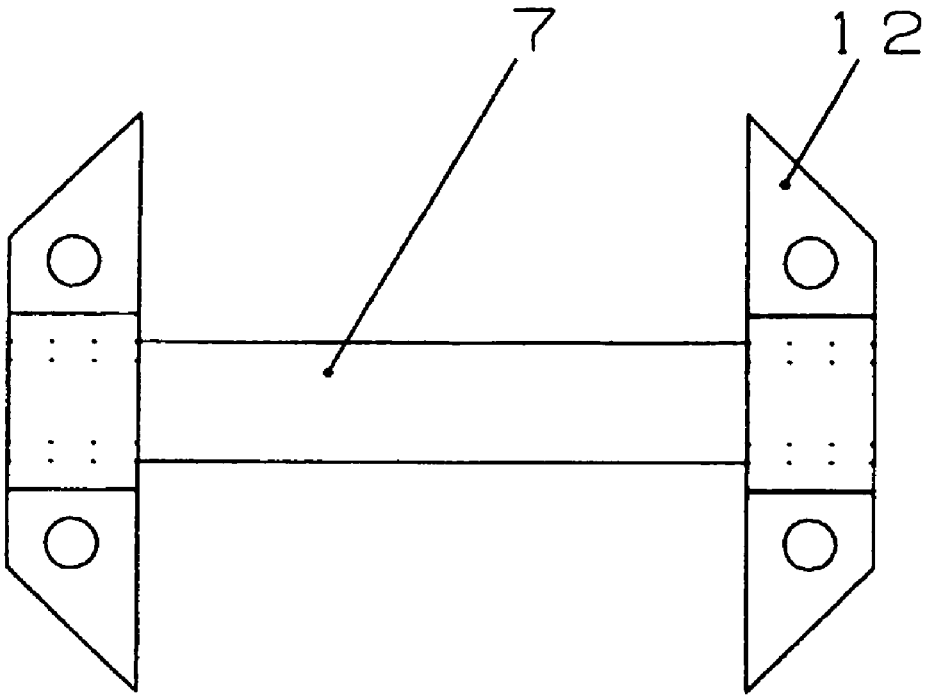
FIG. 2A is a plan diagram.
Figure 2B:
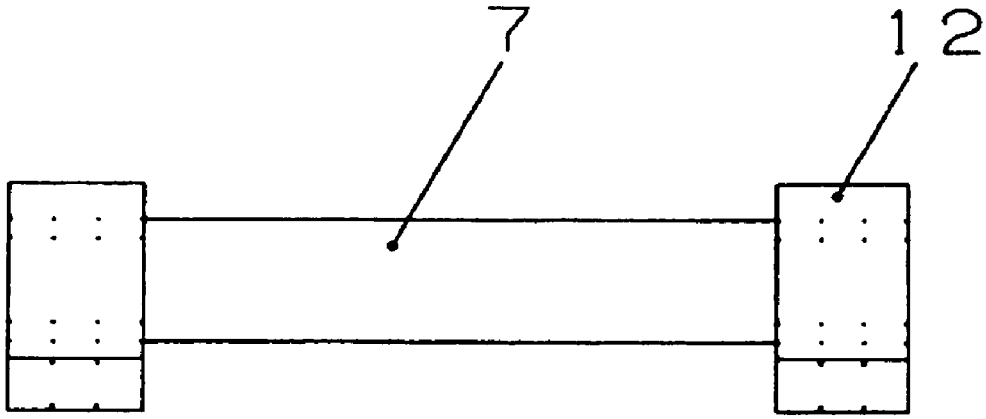
Figure 2C:
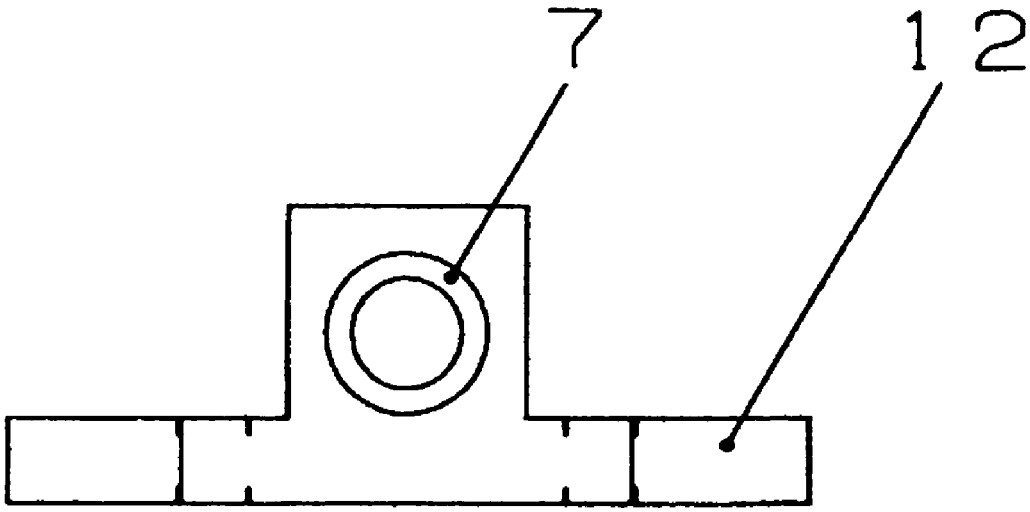

The round bars (7) in FIG. 1 are formed so as to be supported by the bearing A (12) at both ends, and rotate with a bush in between, as shown in FIG. 2. Though it is not necessary for the round bars to be rotatable according to the present invention, rotatable round bars make smoother movement possible when the round bars and the flat bar are moved relative to each other. FIG. 2 is a diagram showing the relationship between the round bars and the bearing; FIG. 2A is a plan diagram FIG. 2B is a front diagram, and FIG. 2C is a side diagram.

Next, as shown in FIG. 3, the round bar, which is inclined by 45 degrees, for example, and to which the bearings are attached as in FIG. 2, is attached on top of a table (13). As described above, it is possible to change the pitch angle of the twisted flat bar by changing the angle at which the round bar is attached. In the following, an example where the round bar is inclined by 45 degrees relative to the longitudinal direction of the flat bar (twisted flat bar) as in FIG. 1 is described.

Figure 3A:
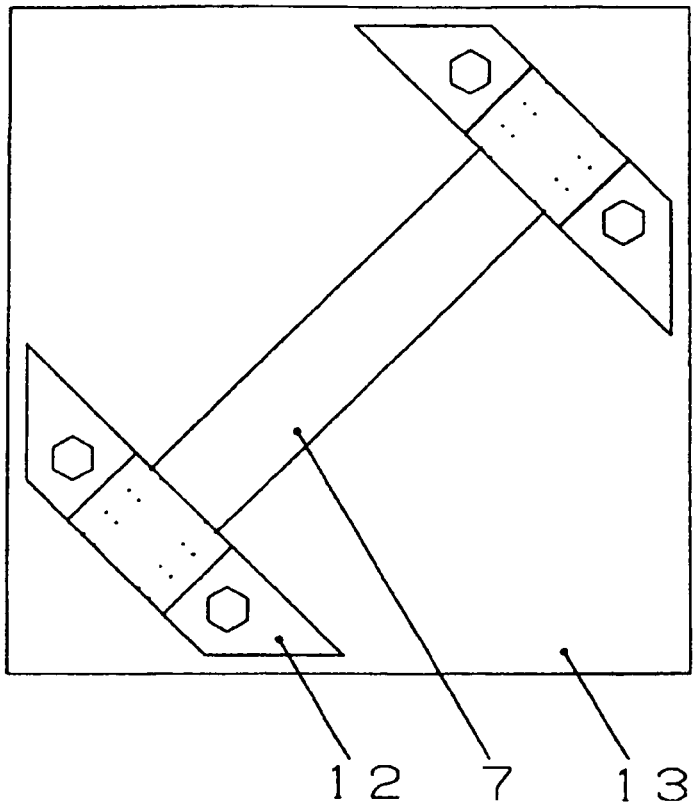
FIG. 3A is a plan diagram and FIG. 3B is a front diagram showing a round bar and its bearings attached to a table.
Figure 3B:
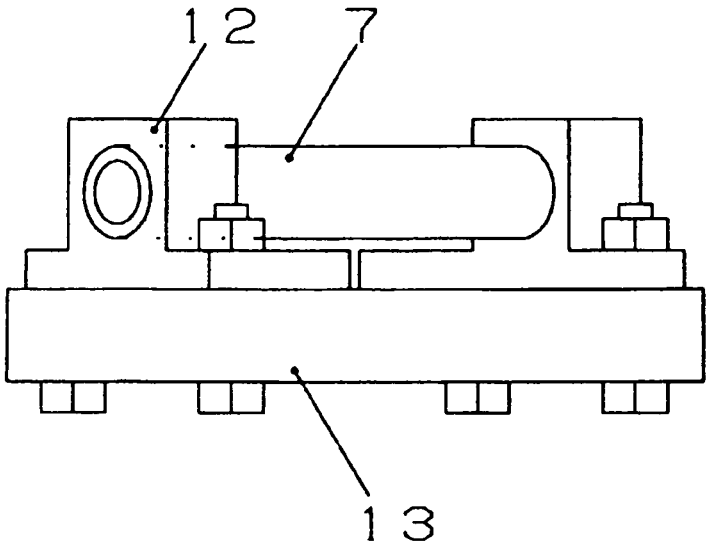

Here, FIG. 3 is a diagram showing the round bar and the bearings attached to a table; FIG. 3A is a plan diagram, and FIG. 3B is a front diagram.

Figure 4:
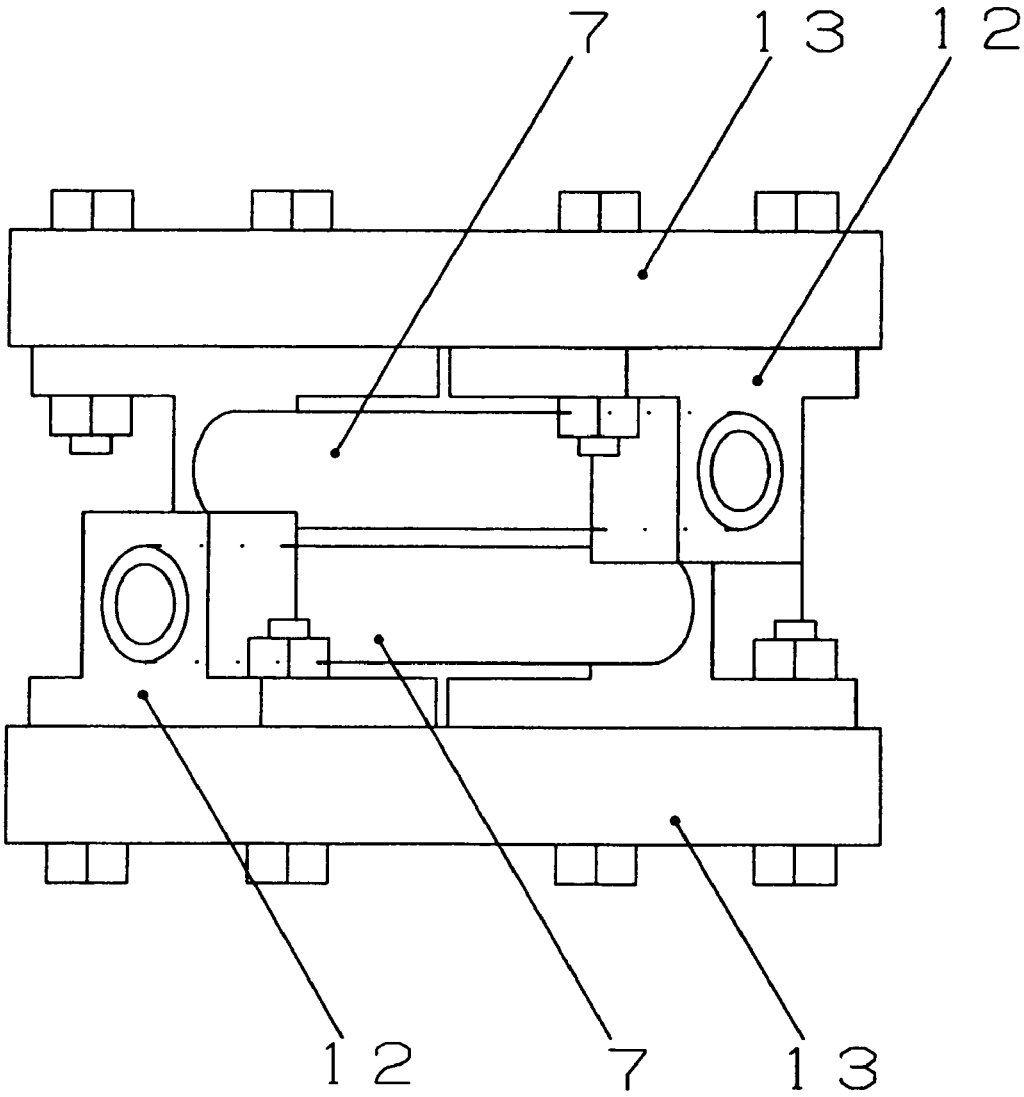
FIG. 4 is a front diagram showing two tables which are combined and each of which has a round bar and its bearings attached.
Figure 5:
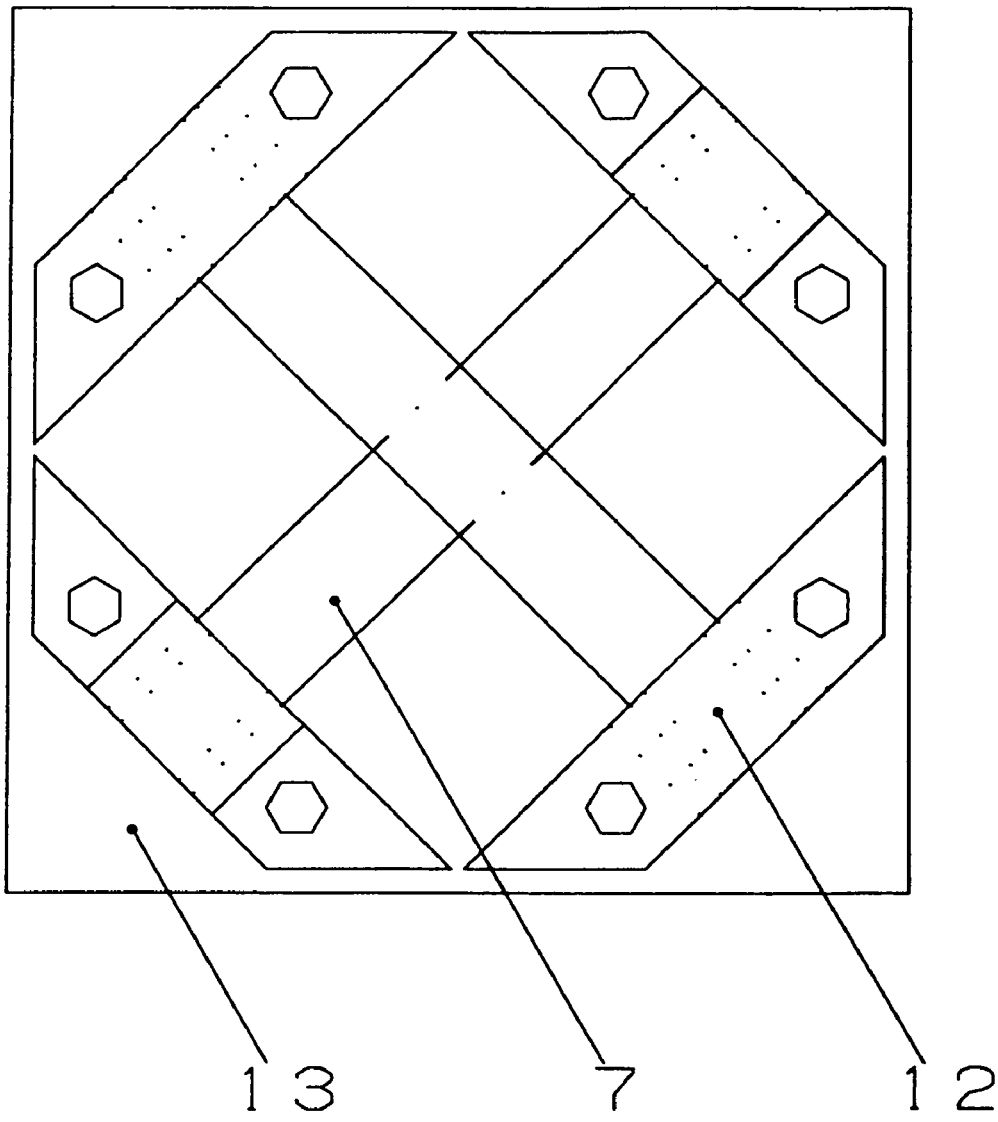
FIG. 5 is a plan diagram showing two tables which are combined and each of which has a round bar and its bearings attached.

Furthermore, as shown in FIGS. 4 and 5, two facing sets of a round bar and bearings attached to a table are prepared, so that the round bars cross at 90 degrees. At this time, the two round bars have a space in between, so that a flat bar can pass through. FIG. 4 is a front diagram showing a combination of two sets of round bar and bearings attached to a table, and FIG. 5 is a plan diagram showing a combination of two sets of round bar and bearings attached to a table.

Figure 6:
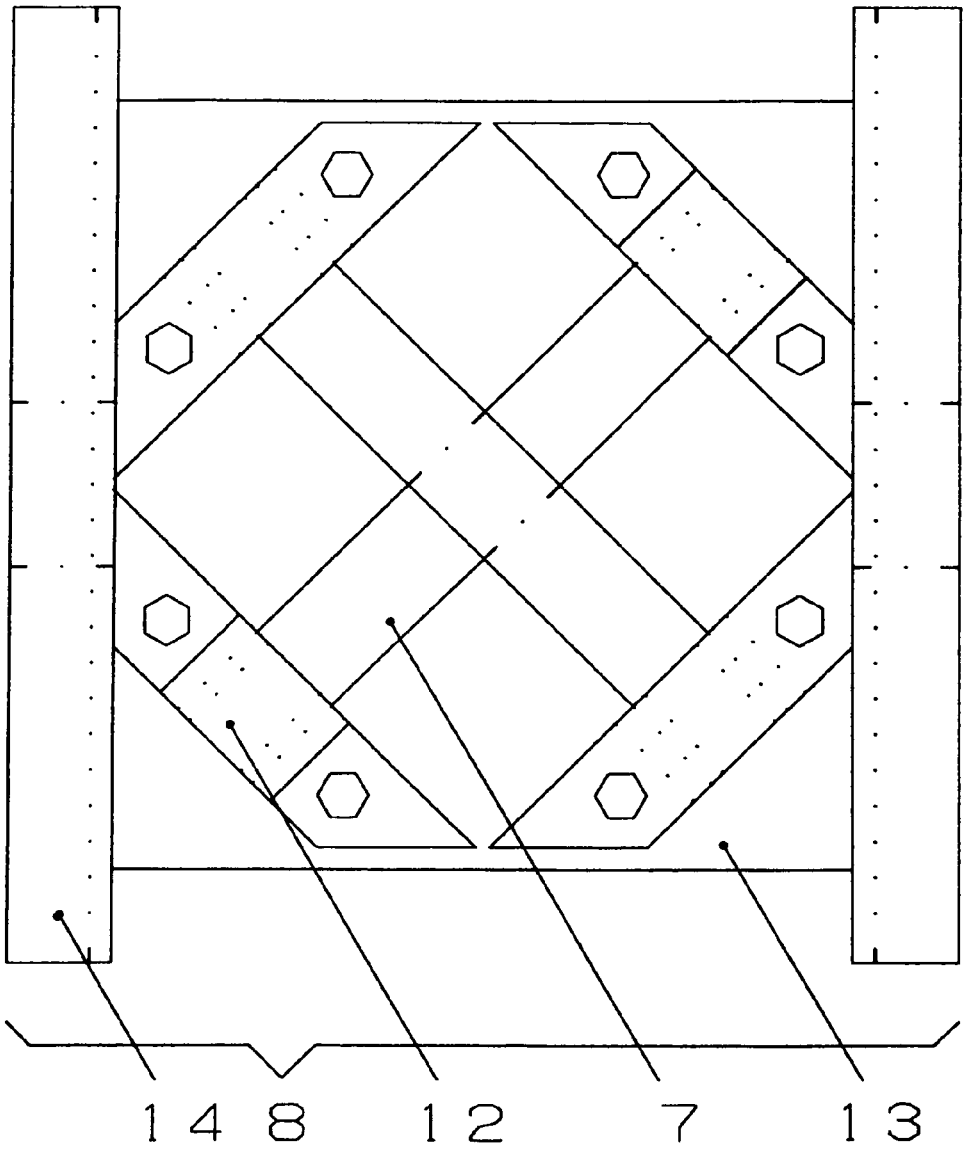
FIG. 6 is a plan diagram showing a table to which a disc is attached.
Figure 7:
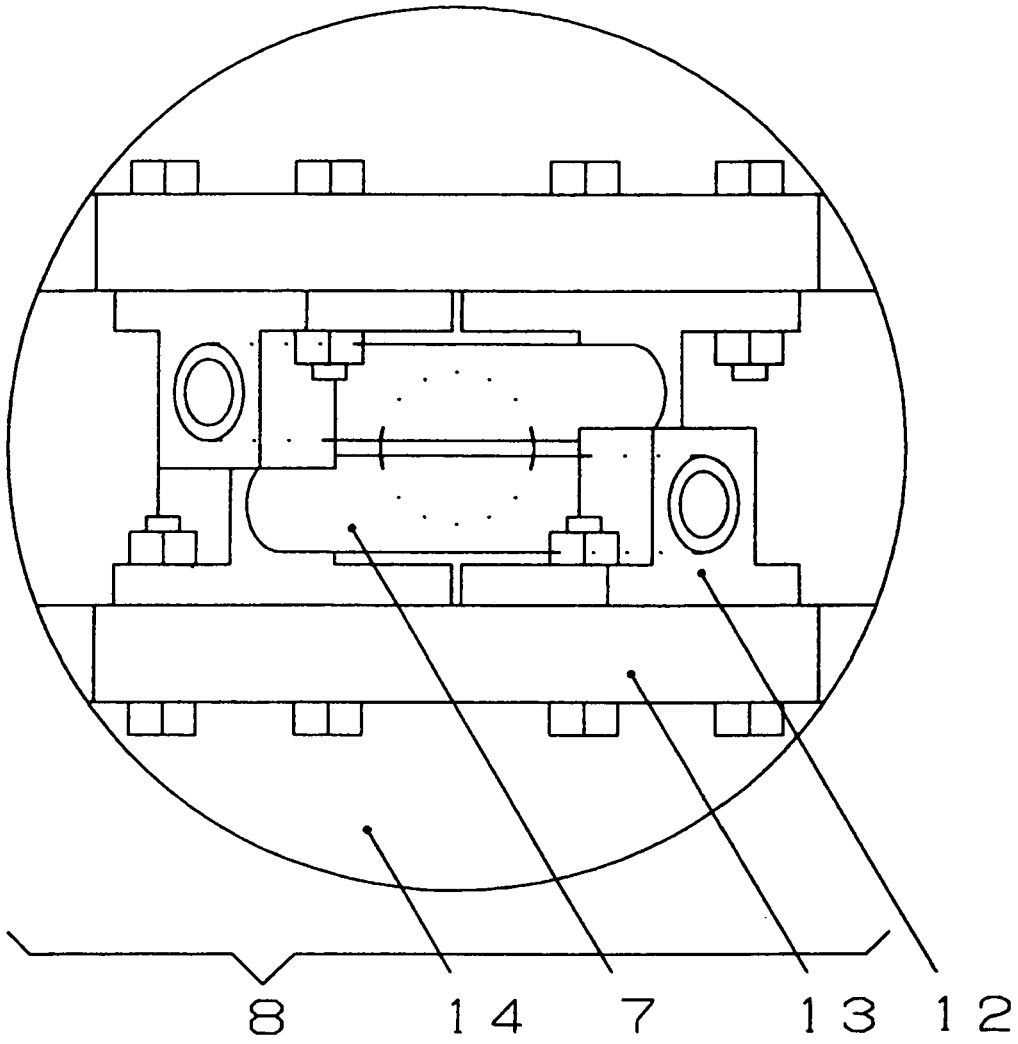
FIG. 7 is a side diagram showing a table to which a disc is attached.

Furthermore, as shown in FIGS. 6 and 7, discs (14) with a hole at the center are attached at the two ends of the table, so that a rotational body (8) is formed. This places two round bars at a certain distance and makes the entirety, including the round bars, rotatable. FIG. 6 is a plan diagram showing a table to which discs are attached, and FIG. 7 is a side diagram showing a table to which discs are attached.

Figure 8:
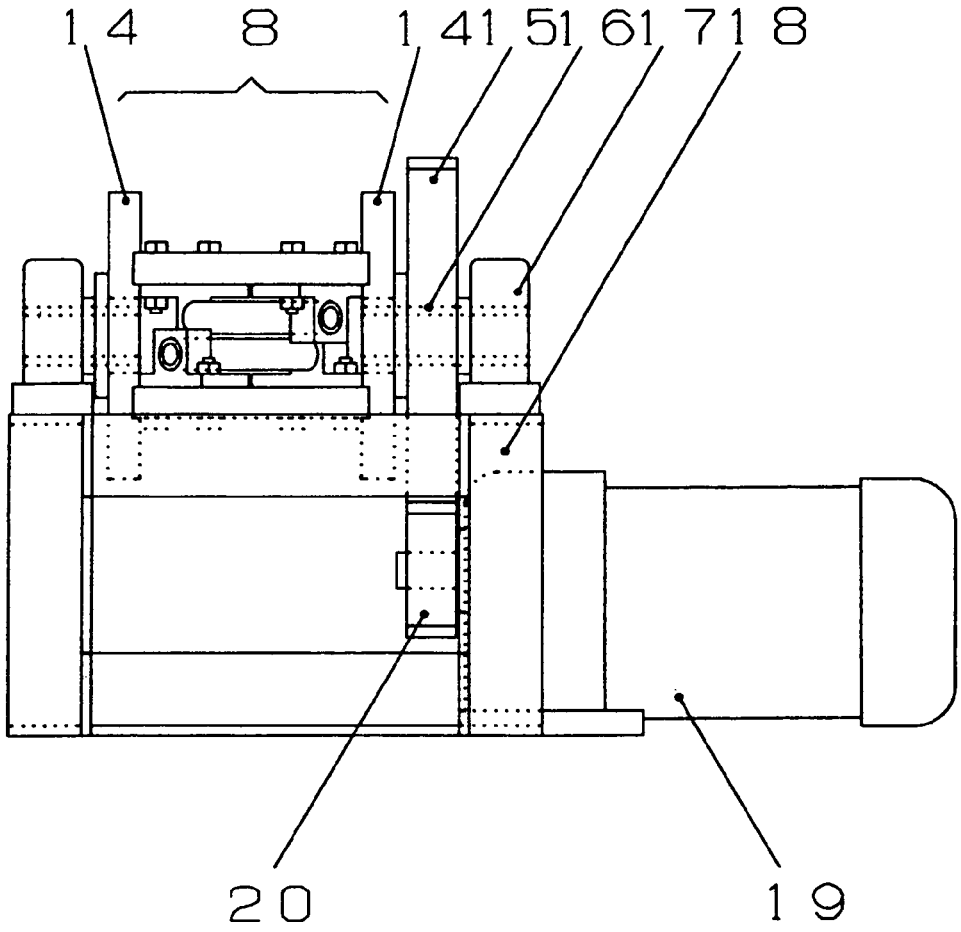
FIG. 8 is a front diagram showing a frame to which a rotational body is attached.

Next, as shown in FIG. 8, a gear A (15) with a hole at the center is attached to one disc (14) of the rotational body (8). In addition, a pipe (16) having an inner diameter that allows a flat bar to pass through is attached to the two discs, so that the two ends are supported by bearings B (17), which are attached to a frame (18). FIG. 8 is a front diagram showing the rotational body attached to the frame.

Furthermore, a motor B (19), which is a rotation drive means, is installed beneath the frame, and a gear B (20) is attached to the output axis of the motor and engaged with the gear A. Thus, the rotational body is rotated by the motor. Here, though the rotation drive means is installed in the frame for supporting the rotational body, the present invention is not limited to this, and it is also possible to rotate the rotational body using a drive conveying means, such as a rotational shaft or a belt, when the rotation drive means is located outside the frame, for example on the base side of the main body of the manufacturing apparatus.

Figure 9:
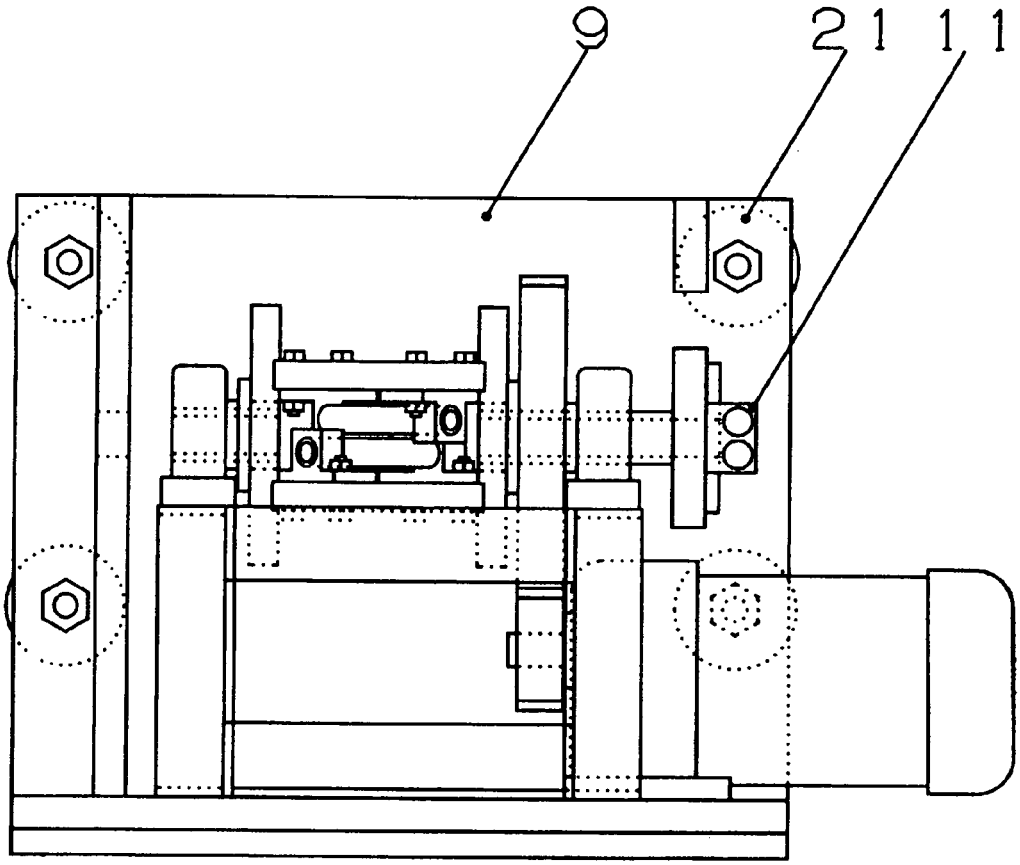
FIG. 9 is a front diagram showing a movable dolly.
Figure 10:
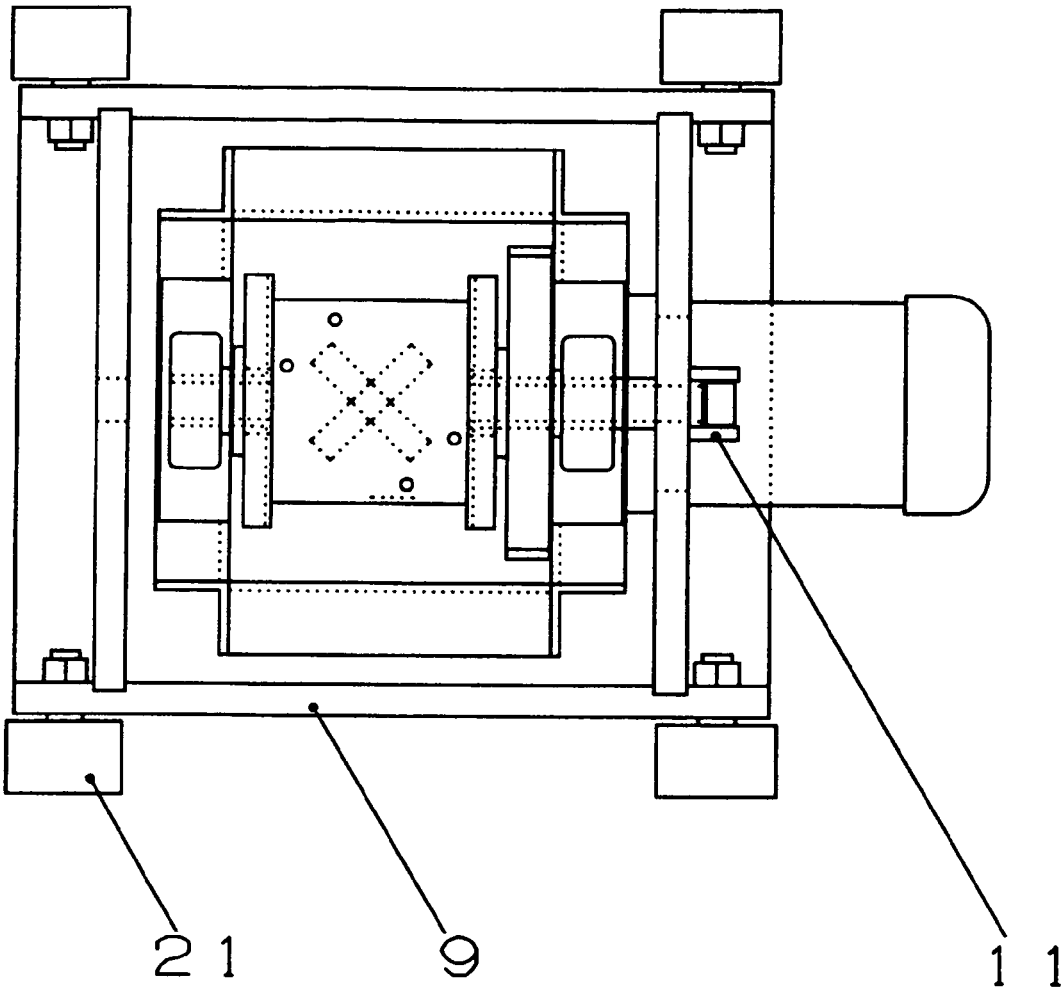
FIG. 10 is a plan diagram showing a movable dolly.
Figure 11:
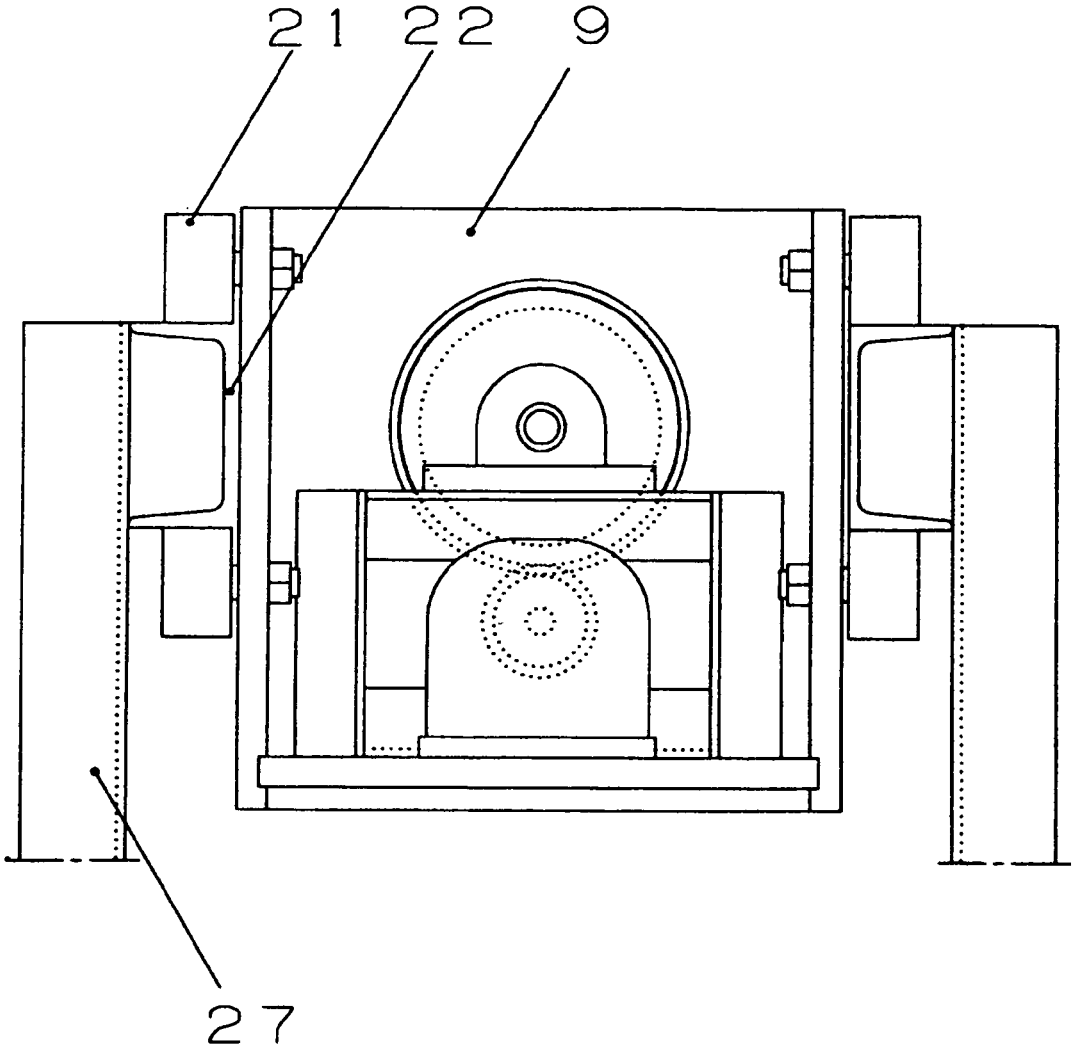
FIG. 11 is a side diagram showing a movable dolly.

Next, as shown in FIGS. 9, 10 and 11, the rotational body assembled in the frame is installed in the movable body (9). FIG. 9 is a front diagram showing the movable dolly, FIG. 10 is a plan diagram showing the movable dolly, and FIG. 11 is a side diagram showing the movable dolly. Four wheels (21) are attached on the two sides of the movable dolly, and as shown in FIG. 11, the wheels sandwich the C-shaped bar (22) of the main body (27), so that the movable dolly is movable.

Next, the first holding means is described. As shown in FIGS. 9 and 10, two rollers (11) sandwiching the flat bar are attached to the rear of the movable dolly (9) as the first holding means.

The first holding means is rotated in the same rotational direction as the rotational body (8), at the same rotational speed, when the flat bar is twisted. As for the mechanism for rotating the first holding means, the first holding means can be connected to the mechanism for rotating the rotational body (8), or a separate rotation drive means can be prepared so as to rotate the first holding means in the configuration.

Furthermore, in the case where the same drive mechanism as the rotational body (8) is used, the connection between the rotational body (8) and the first holding means breaks when a flat bar is set in the manufacturing apparatus in advance, so that the state becomes as in FIG. 15B, and after that, the two are connected, so that the rotational body (8) and the first holding means can be rotated together.

The first holding means is not limited to the rollers having the form and arrangement in the figure, and they may be provided so as to be inclined at a predetermined angle relative to the longitudinal direction of the flat bar, just as the two round bars, so that the pitch and the pitch angle can be adjusted when the rollers work together with the round bars during the twisting process.

Figure 12:
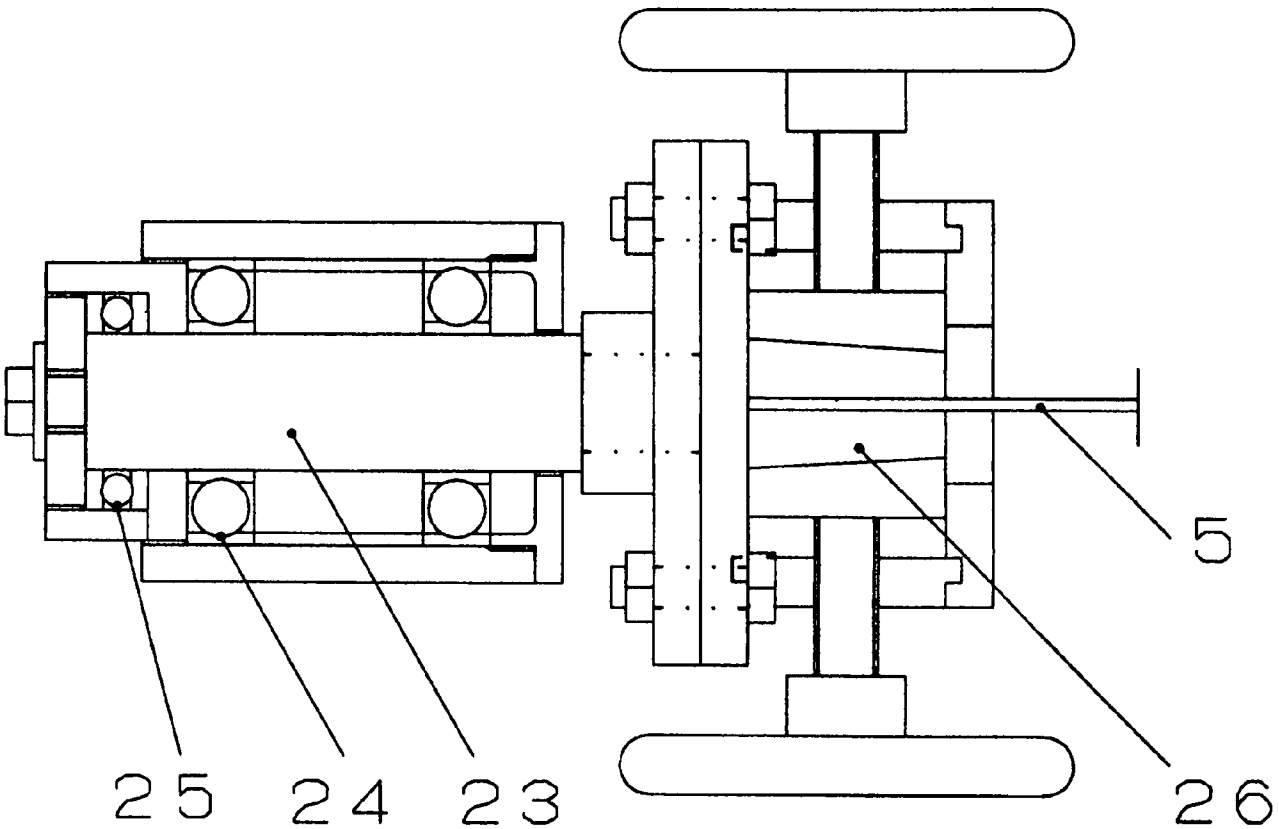
FIG. 12 is a front diagram showing a fixed portion.

Next, the fixed portion (10), which is the second holding means, is described. FIG. 12 is a front diagram showing the fixed portion.

The fixed portion firmly fixes an end of a flat bar (5) so as to bear the tensile force when the round bars move relative to the flat bar, and furthermore, it is preferable for the fixed portion itself to be rotatable. Therefore, the fixed axis (23) has such a structure as to be supported by two ball bearings (24), so that the end of the axis takes the tensile force through the thrust bearing (25).

Tapered holding plates (26) are pressed against the flat bar from the two sides using a handle, so that the flat bar is prevented from being removed and thus fixed.

Furthermore, a lock mechanism (not shown) for locking the fixed axis 23 is provided, so that the fixed portion does not rotate when the flat bar is twisted.

In addition, the second holding means is not limited to a fixed portion, as in FIG. 12, and may have such a structure as to hold the twisted flat bar so that it can pass through and be rotatable in the same direction as the rotational body for holding the round bars as it rotates. Thus, it is preferable for the flat bar to be pinched from the two sides by two balls or two rollers positioned at a predetermined angle as round bars, for example, so that the frame for holding the balls or rollers are rotatable.

Figure 13:
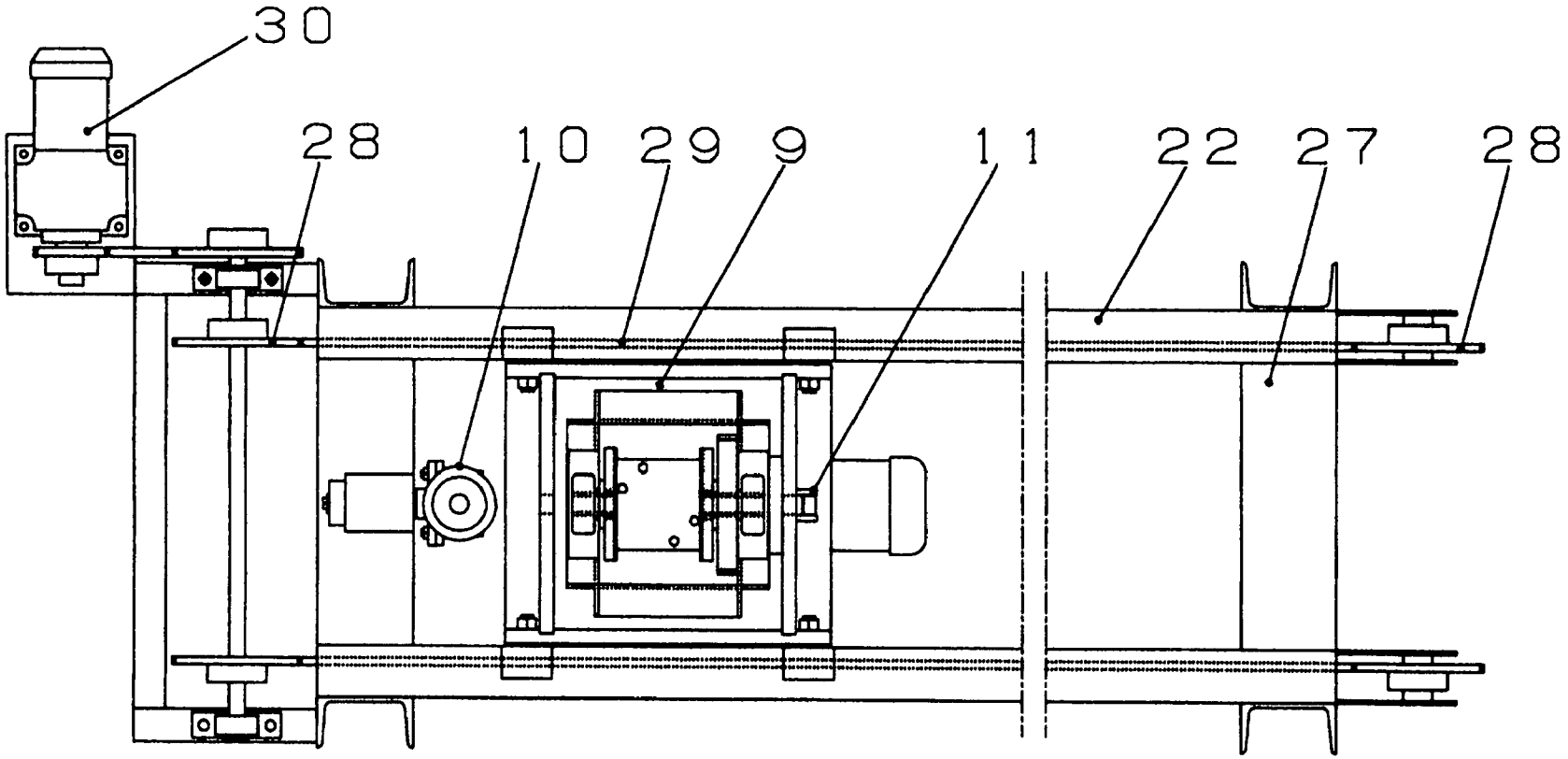
FIG. 13 is a plan diagram showing a manufacturing machine.
Figure 14:
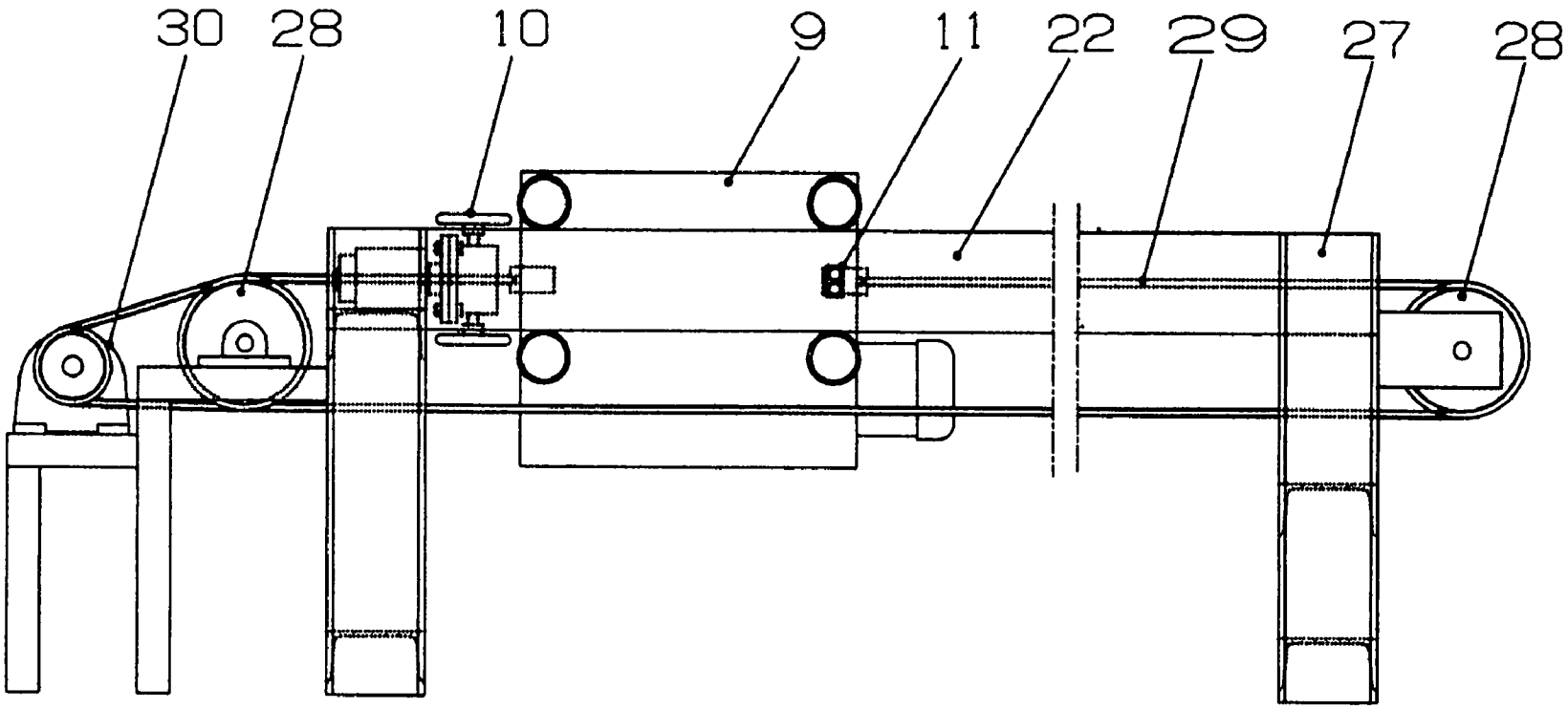
FIG. 14 is a front diagram showing a manufacturing machine.

Next, the moving apparatus for the movable dolly is described in reference to FIGS. 13 and 14 showing the entirety of the manufacturing apparatus. FIG. 13 is a plan diagram showing the manufacturing machine, and FIG. 14 is a front diagram showing the manufacturing machine.

First, the movable dolly (9) is installed in the main body (27) to which two C-shaped bars (22) are attached in parallel. Next, two sprockets (28) are provided at either end of the main dolly.

Next, one end of the chain (29) is attached to the movable dolly, and the other end is wound around the two sprockets so as to return and be attached to the movable dolly. Then, one sprocket is driven by a motor C (30), so that the movable dolly moves left and right.

The speed at which the movable dolly moves depends on the rotational speed at which the round bars (7) and the first holding means (11) rotate. Concretely, the movable dolly is formed so as to move twice the length of the pitch of the flat bar in the longitudinal direction of the flat bar, while the rotational body (8) for holding the round bars rotates once around the flat bar.

In addition, the fixed portion (10) is fixed in front of the movable dolly in the manufacturing machine. Furthermore, a separate means, not shown, for rotating and holding the flat bar (5) as the first holding means rotates is provided at the rear of the movable dolly (to the right in the figure).

FIG. 16 is a diagram showing the manufacturing apparatus (manufacturing method) for a flat bar according to another embodiment of the present invention. In the embodiment in FIG. 16, a rotational body (8) having round bars (7) as those in the above embodiment is used.

The rotational body (8) is installed in a base (33) in such a state as to be rotatable. In addition, a conveyance means (31), such as a conveyance roller, which can convey a flat bar (5) in the longitudinal direction is provided on the base (33) at a point at a predetermined distance from the rotational body (8) in the longitudinal direction of the flat bar.

Though it is basically possible to twist the flat bar (5) between the conveyance means (31) and the rotational body (8) (particularly round bars), in this case it is necessary for the conveyance means to have sufficient mechanical strength to bear the rotational force (twisting force) of the rotational body (8), and the structure of the conveyance means becomes complex or large-scale, and the cost is high. Therefore, two holding rollers (32) can be formed so as to sandwich the flat bar between the conveyance means (31) and the rotational body (8), so that the twisting operation is carried out by the rotational body and the holding rollers while the conveyance means exclusively has a conveying function.

Next, the steps for manufacturing the twisted flat bar according to the embodiment in FIG. 16 is described.

Figure 16A:
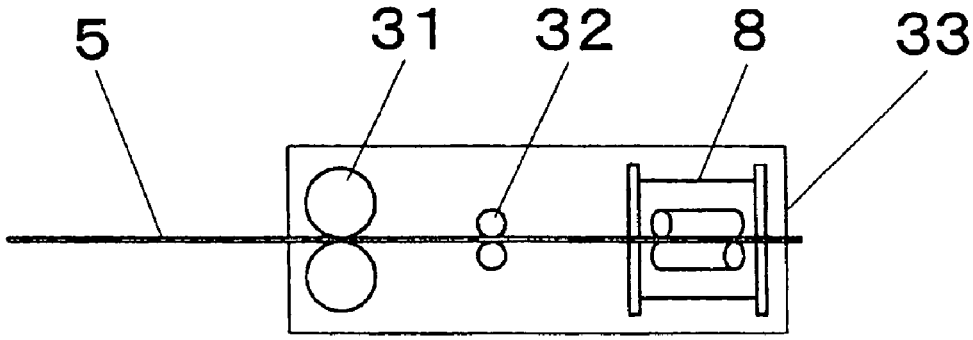
FIGS. 16A, 16B, 16C, 16D and 16E are diagrams showing the working steps of inserting a flat bar, starting twisting in an end portion through the rotation of round bars, conveying the flat bar and twisting it through the rotation of round bars, stopping the rotation of the round bars and conveyance of the flat bar, and taking out the twisted flat bar according to another embodiment of the present invention.

First, in FIG. 16A, a flat bar (5) is inserted into the manufacturing apparatus for a twisted flat bar including a base 33. Though insertion is possible using a conveyance means 31, a separate mechanism for conveying a flat bar (5) may be installed outside the manufacturing apparatus, so that the structure allows the flat bar (5) to be inserted up to a predetermined point in the manufacturing apparatus. Here, the rotational body (8) is not rotating at that point.

Figure 16B:
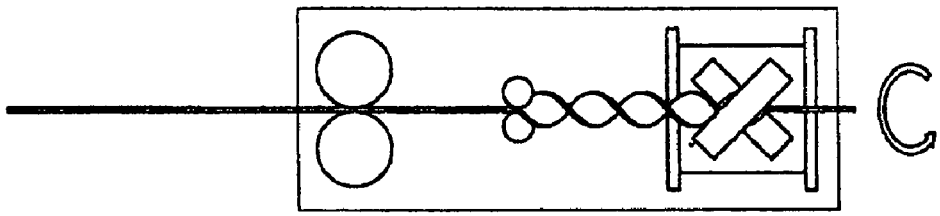
Figure 16C:
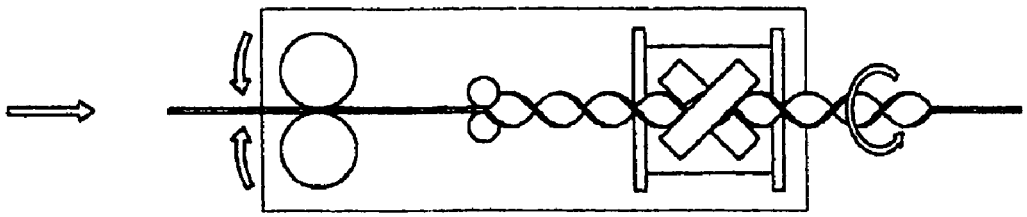

In FIG. 16B, the rotational body (8) is rotated in such a state that the flat bar (5) is not being conveyed, and the end portion of the flat bar (5) is twisted as the round bars of the rotational body rotate. Next, as shown in FIG. 16C, the rotational body (8) is rotated while the flat bar (5) is conveyed by the conveying means (31), so that a continuous twisting operation is carried out on the flat bar between the holding rollers 32 and the round bars (rotational body (8)). In addition, the twisted flat bar is discharged continuously to the right of the rotational body (8).

Figure 16D:
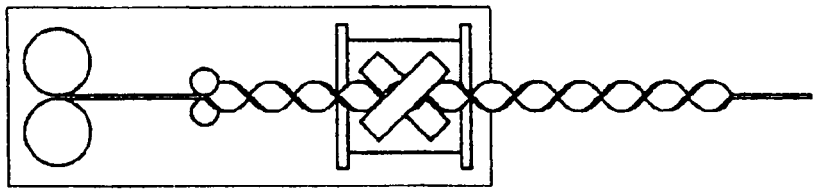
Figure 16E:
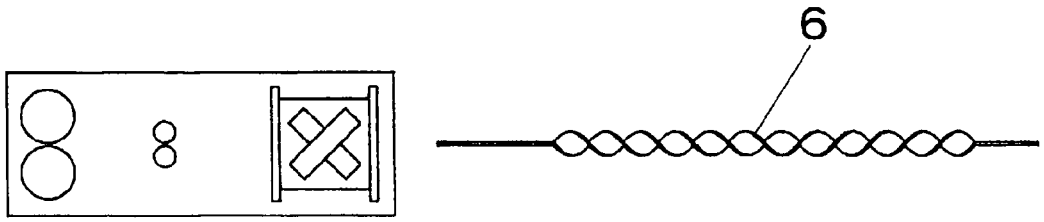
Figure 17A:
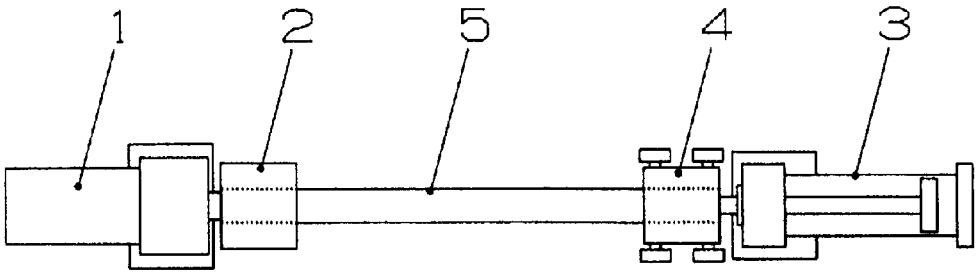
FIG.17A PRIOR ART
FIGS. 17A and 17B are diagrams showing conventional working steps of inserting a flat bar and finishing twisting.
Figure 17B:
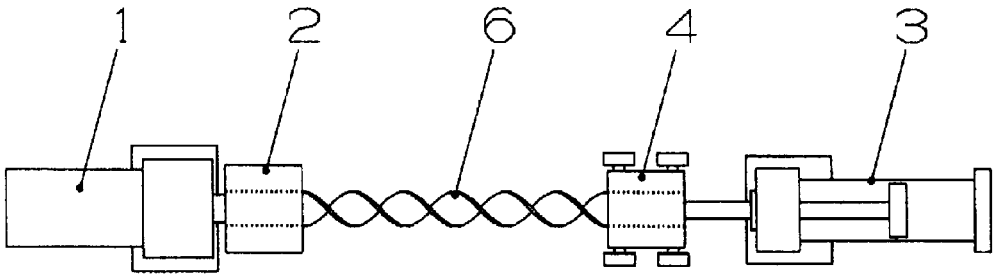
FIG.17B PRIOR ART

When a predetermined twisting process is complete, as shown in FIG. 16D, the rotation of the rotational body (8) including the round bars and the operation of the conveyance means (31) for conveying the flat bar stops. Thus, as shown in FIG. 16E, the twisted flat bar 6 is taken out from the manufacturing apparatus.

In the embodiment in FIG. 16, one end portion of the flat bar 5 is not fixed or held, unlike in the embodiment in FIG. 15, and the entirety of the manufacturing apparatus is installed on top of the base (33) without any portion moving in the direction in which the flat bar (5) is conveyed, and therefore, it is possible to continuously feed a flat bar into the manufacturing apparatus, and it becomes possible to twist flat bars while continuously them from a blast furnace or a rolling mill, for example. Naturally the twisting process can be carried out regardless of whether the flat bar is hot rolled or cold rolled.

INDUSTRIAL APPLICABILITY

The manufacturing method and manufacturing apparatus for a twisted flat bar according to the invention make it possible to twist a flat bar along the entire length thereof with a precise pitch, and therefore, a high quality twisted flat bar can be gained. In addition, it becomes possible to use a twisted flat bar for new fields, such as conveyance apparatuses and ornaments inside and outside buildings, which is difficult according to the prior art.

The invention claimed is:

1. A manufacturing method for a twisted flat bar, comprising the steps of:

sandwiching a flat bar between two round bars, said round bars being positioned so as to be inclined at a same angle in different directions relative to a longitudinal direction of the flat bar from two sides, holding the flat bar by a first holding means and a second holding means positioned on either side of the round bars in the longitudinal direction of the flat bar, and rotating the round bars and the first holding means around a rotational axis in the longitudinal direction of the flat bar relative to the second holding means, and at the same time, moving the round bars and the first holding means relative to the second holding means in the longitudinal direction of the flat bar so as to move away from the second holding means.

2. The manufacturing method for a twisted flat bar according to claim 1, wherein the first holding means holds the flat bar in such a manner that the flat bar is moveable relative to the first holding means in the longitudinal direction of the flat bar, while the second holding means holds the flat bar in such a manner that the flat bar is prevented from moving relative to the second holding means in the longitudinal direction of the flat bar.

3. The manufacturing method for a twisted flat bar according to claim 2, wherein the round bars and the first holding means move in the longitudinal direction of the flat bar while maintaining a predetermined distance from each other, and at the same time, the round bars and the first holding means rotate around the rotational axis in the longitudinal direction of the flat bar while maintaining a predetermined rotational angle.

4. The manufacturing method for a twisted flat bar according to claim 1, wherein the round bars and the first holding means move in the longitudinal direction of the flat bar while maintaining a predetermined distance from each other, and at the same time, the round bars and the first holding means rotate around the rotational axis in the longitudinal direction of the flat bar while maintaining a predetermined rotational angle.

5. A manufacturing apparatus for a twisted flat bar, comprising:

two round bars positioned to be inclined at a same angle in different directions relative to a longitudinal direction of the flat bar, for sandwiching the flat bar from two sides;

a first holding means and a second holding means for holding the flat bar, said first holding means and said second holding means being positioned on either side of the round bars at a distance from each other in the longitudinal direction of the flat bar;

a rotational means for rotating the round bars and the first holding means around a rotational axis in the longitudinal direction of the flat bar relative to the second holding means; and a moving means for moving the round bars and the first holding means in the longitudinal direction of the flat bar relative to the flat bar.

6. The manufacturing apparatus for a twisted flat bar according to claim 5, wherein the first holding means is formed to hold the flat bar in such a manner that the flat bar is moveable relative to the first holding means in the longitudinal direction of the flat bar, while the second holding means is formed to hold the flat bar in such a manner that the flat bar is prevented from moving relative to the second holding means in the longitudinal direction of the flat bar.

7. The manufacturing apparatus for a twisted flat bar according to claim 6, wherein at least the round bars and the first holding means are integrally incorporated in a movable dolly.

8. The manufacturing apparatus for a twisted flat bar according to claim 6, wherein the rotational means comprises a rotational body which incorporates the round bars, and a rotational drive means for rotating the rotational body.

9. The manufacturing apparatus for a twisted flat bar according to claim 6, wherein the first holding means comprises two rollers for sandwiching the flat bar from two sides.

10. The manufacturing apparatus for a twisted flat bar according to claim 5, wherein at least the round bars and the first holding means are integrally incorporated in a movable dolly.

11. The manufacturing apparatus for a twisted flat bar according to claim 10, wherein the rotational means comprises a rotational body which incorporates the round bars, and a rotational drive means for rotating the rotational body.

12. The manufacturing apparatus for a twisted flat bar according to claim 10, wherein the first holding means comprises two rollers for sandwiching the flat bar from two sides.

13. The manufacturing apparatus for a twisted flat bar according to claim 5, wherein the rotational means comprises a rotational body which incorporates the round bars, and a rotational drive means for rotating the rotational body.

14. The manufacturing apparatus for a twisted flat bar according to claim 13, wherein the first holding means comprises two rollers for sandwiching the flat bar from two sides.

15. The manufacturing apparatus for a twisted flat bar according to claim 5, wherein the first holding means comprises two rollers for sandwiching the flat bar from two sides.

16. A manufacturing apparatus for a twisted flat bar, comprising:

two round bars positioned so as to be inclined at a same angle in different directions relative to a longitudinal direction of the flat bar, for sandwiching the flat bar from two sides;

a rotational means for rotating the round bars relative to the flat bar around a rotational axis in the longitudinal direction of the flat bar;

a conveyance means for moving the flat bar relative to the round bars in the longitudinal direction of the flat bar; and holding rollers for sandwiching the flat bar, said holding rollers being positioned between the rotational means and the conveyance means, and being formed so that the flat bar is twisted between the holding rollers and the round bars.

* * * * *